US010799921B2

(12) United States Patent
Rechlin

(10) Patent No.: US 10,799,921 B2
(45) Date of Patent: Oct. 13, 2020

(54) DRAIN LINE CLEANING DEVICE AND KIT

(71) Applicant: Neil Rechlin, Davenport, FL (US)

(72) Inventor: Neil Rechlin, Davenport, FL (US)

( * ) Notice: Subject to any disclaimer, the term of this patent is extended or adjusted under 35 U.S.C. 154(b) by 0 days.

(21) Appl. No.: 15/893,356

(22) Filed: Feb. 9, 2018

(65) Prior Publication Data

US 2019/0247897 A1 Aug. 15, 2019

(51) Int. Cl.
*B08B 9/032* (2006.01)
*F28F 17/00* (2006.01)
*F28G 1/16* (2006.01)

(52) U.S. Cl.
CPC ..... *B08B 9/032* (2013.01); *F28F 17/005* (2013.01); *F28G 1/163* (2013.01)

(58) Field of Classification Search
CPC ..... B08B 9/032; F28F 17/005; F28G 1/163
See application file for complete search history.

(56) References Cited

U.S. PATENT DOCUMENTS 1,782,531 A * 11/1930 Fokker ..... B01D 29/117 210/407
2,176,699 A * 10/1939 Anderson ..... A62C 2/08 239/441
2,215,132 A * 9/1940 Parker ..... B05B 7/30 417/181
2,568,515 A * 9/1951 Scheiwer ..... B05B 1/14 239/289
2,627,439 A * 2/1953 Wornall ..... B05B 1/3402 239/539
2,802,697 A * 8/1957 Pumphrey ..... B60S 3/044 239/428
3,491,884 A * 1/1970 Baker ..... B01D 24/167 210/167.13
4,194,765 A * 3/1980 Reddy ..... F16L 37/04 285/27
4,460,019 A * 7/1984 Condon ..... E03F 7/00 138/90
5,011,084 A * 4/1991 Toland ..... B05B 1/32 239/546
6,006,766 A * 12/1999 Soulages ..... E03F 9/00 134/166 C
6,036,117 A * 3/2000 Heren ..... B05B 15/65 239/456
6,182,677 B1 * 2/2001 Pignataro ..... B08B 9/0321 134/166 C
6,301,917 B1 * 10/2001 Lacoste ..... F24F 13/222 137/240
6,311,501 B1 * 11/2001 Allison ..... F25C 1/12 62/303
6,427,458 B1 * 8/2002 Fowler ..... F24F 13/222 137/565.23
6,651,690 B1 * 11/2003 Coogle ..... C02F 1/688 137/268
6,701,740 B1 * 3/2004 Hernandez-Zelaya ..... F24F 13/222 137/625.47
6,708,717 B1 * 3/2004 Coogle ..... B08B 9/0321 134/166 C
6,745,580 B1 * 6/2004 Brown ..... F24F 13/222 137/192

(Continued)

*Primary Examiner* — Benjamin L Osterhout
(74) *Attorney, Agent, or Firm* — Cygnet IP Law, P.A.; Stephen W. Aycock, II

(57) ABSTRACT

A drain line cleaning device and kit are described.

9 Claims, 7 Drawing Sheets

(56) References Cited

U.S. PATENT DOCUMENTS

| | | | | |
|---|---|---|---|---|
| 7,624,756 | B1 * | 12/2009 | Coogle | F24F 13/222 137/240 |
| 8,156,956 | B1 * | 4/2012 | Coogle | F16L 55/07 137/240 |
| 8,479,760 | B2 * | 7/2013 | Eads | F24F 13/222 137/240 |
| 8,752,865 | B1 * | 6/2014 | Coogle | F24F 13/222 137/240 |
| 8,985,635 | B2 * | 3/2015 | Hurley | F24F 13/222 285/179 |
| 9,010,355 | B1 * | 4/2015 | Achez | F01P 3/205 137/238 |
| 2003/0056812 | A1 * | 3/2003 | Baker | B08B 3/04 134/36 |
| 2004/0139994 | A1 * | 7/2004 | Drukarov | B08B 3/02 134/198 |
| 2006/0096307 | A1 * | 5/2006 | Coogle | F16L 55/07 62/272 |
| 2008/0121309 | A1 * | 5/2008 | Boise | A63H 27/10 141/313 |
| 2012/0000233 | A1 * | 1/2012 | Eads | F24F 13/222 62/303 |
| 2014/0062077 | A1 * | 3/2014 | Hurley | F24F 13/222 285/7 |
| 2015/0059868 | A1 * | 3/2015 | Oakner | F24F 13/02 137/240 |

* cited by examiner

DRAIN LINE CLEANING DEVICE AND KIT

Embodiments relate generally to drain line cleaning devices and more particularly to a device and kit for cleaning air conditioner condensate drain lines.

Condensate drain lines can often be difficult to clean due to the location of air handlers (e.g., in an attic) and limited accessibility to the condensate drain line at or near the source of condensate (e.g., the air handler).

Embodiments were conceived in light of the above-mentioned problems and limitations, among other things.

DETAILED DESCRIPTION

Figure 1:
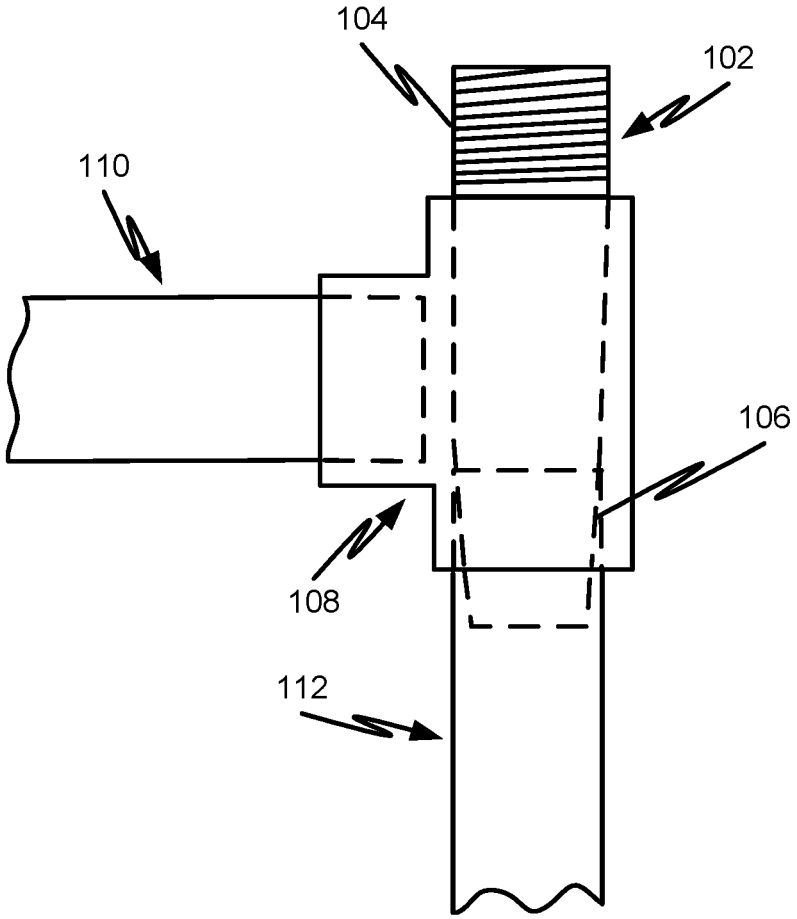
FIG. 1 shows a side elevation view of a drain cleaning device in accordance with some implementations.

FIG. 1 shows a side elevation view of a drain cleaning device 102 in accordance with some implementations. The drain line cleaning device 102 includes a threaded upper portion 104, and a tapered lower portion 106. The drain line cleaning device is constructed to be inserted into a plumbing connector (e.g., tee 108). In FIG. 1, the plumbing connector 108 connects a condensate line 110 coming from a source of condensate (or other fluid) such as an air handler to a drain line 112 that carries the condensate to a drainage area (e.g., outside of a building or into a sewage line, etc.).

The drain cleaning device 102 tapered lower portion is inserted (e.g., via an interference fit) into an opening of the drain line 112 within the connector 108.

In operation, a connector or hose can be connected to the threaded upper portion 104 to supply fluid (e.g., water, air, or cleaning fluid such as a bleach solution) to help clean and clear the drain line 112 of buildup (e.g., mold, slime, etc.) or debris, while preventing the fluid from flowing back into condensate line 110.

Figure 2:
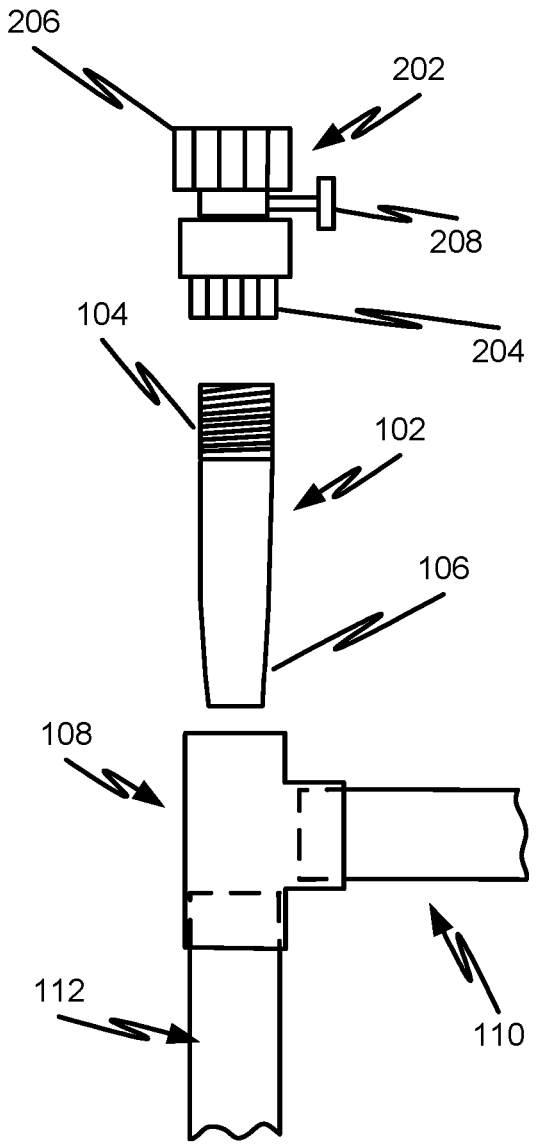
FIG. 2 shows an exploded view of a condensate drain line cleaning device in accordance with some implementations.

FIG. 2 shows an exploded view of a condensate drain line cleaning device 102 in accordance with some implementations. FIG. 2 shows a hose connector 202 that includes a first threaded connector 204 that connects the hose connector 202 to the upper threaded portion 104 of the condensate drain line cleaning device 102. The hose connector 202 also include a second threaded portion 206 to connect to a hose or other device, and a valve 208 that is adjustable to control the flow of fluid through the hose connector 202 (e.g., permit or not permit fluid flow through the hose connector 202).

Figure 3:
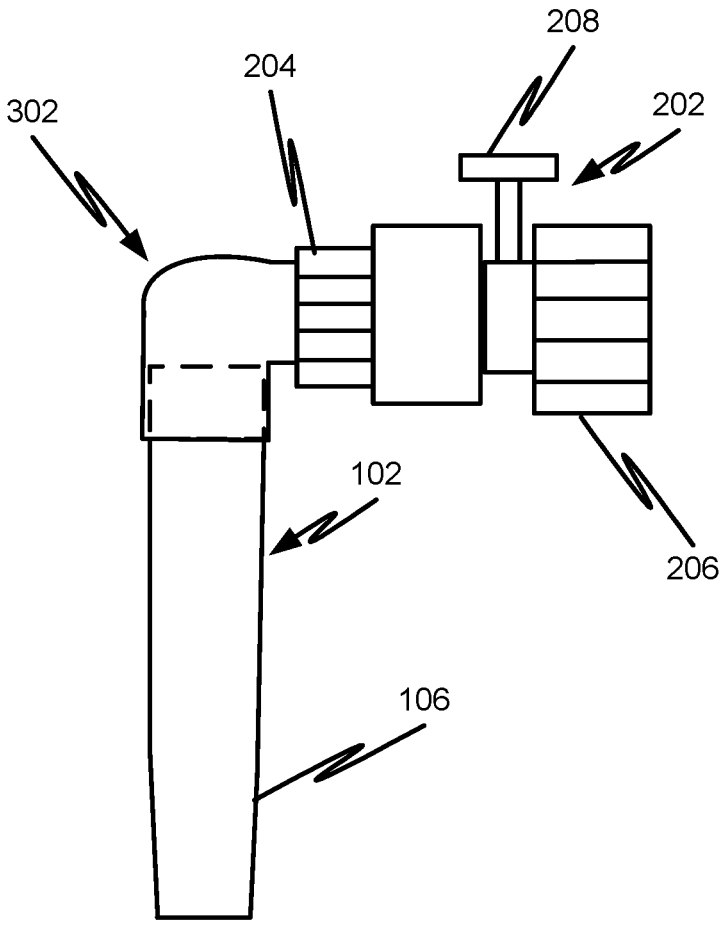
FIG. 3 shows a side elevation view of a drain cleaning device in accordance with some implementations.

FIG. 3 shows a side elevation view of a drain cleaning device in accordance with some implementations. As shown in FIG. 3, the device includes 102 and 202 as described above, and an angled connector 302 (e.g., a ninety degree elbow connector) to provide for an arrangement that may be easier to use when connecting a hose in some circumstances.

Figure 4:
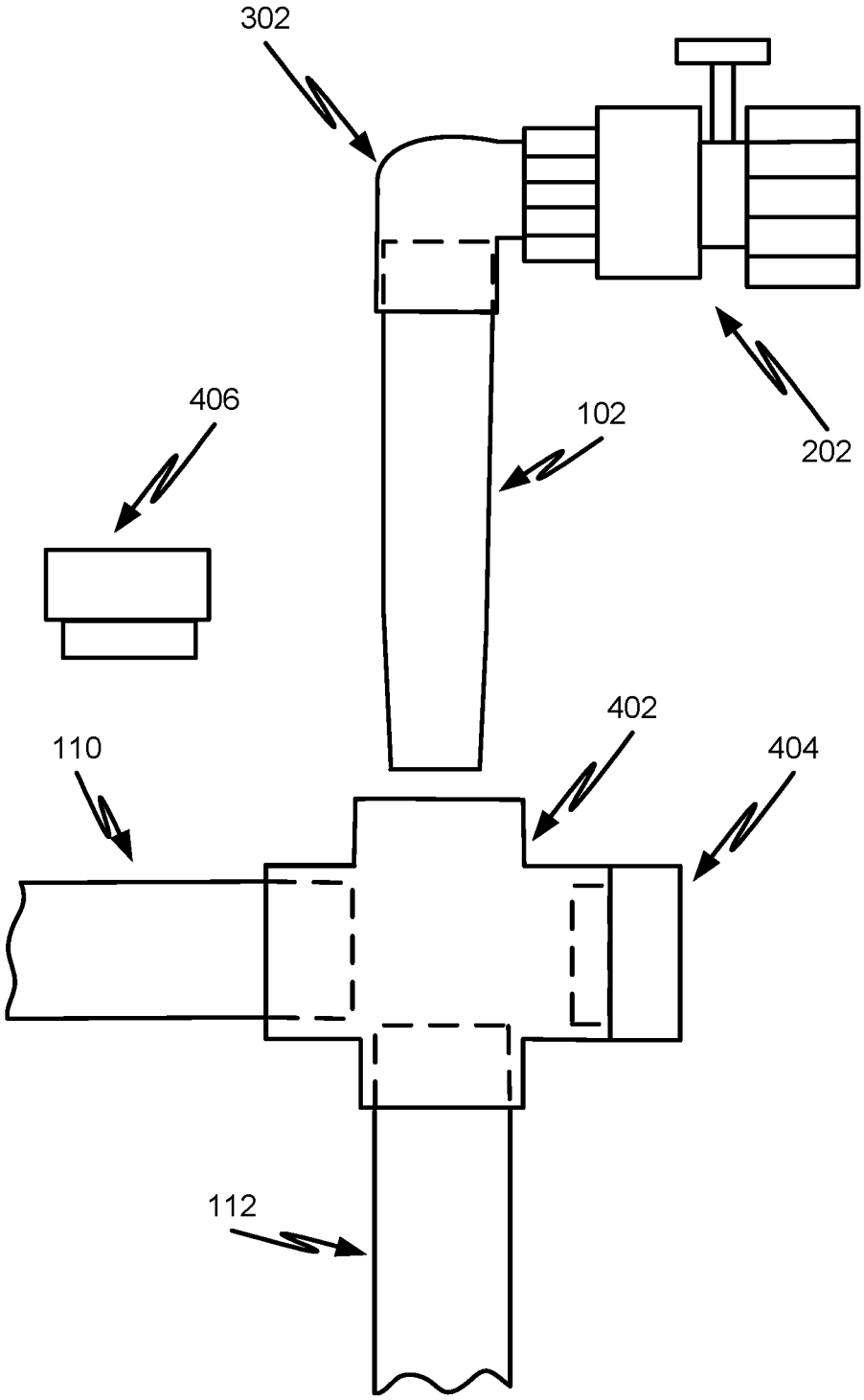
FIG. 4 shows an exploded view of a condensate drain line cleaning device in accordance with some implementations.

FIG. 4 shows an exploded view of a condensate drain line cleaning device in accordance with some implementations. FIG. shows 102 and 202 as described above. In addition, FIG. 4 shows a four-way connector 402, a first end cap 404 inserted into the connector, and a second end cap 406 that is shown removed, but can be inserted into the connector. After performing a drain line cleaning operation, the second end cap 406 can be replaced into the connector opening through which the drain line cleaning device 102 was inserted.

Figure 5:
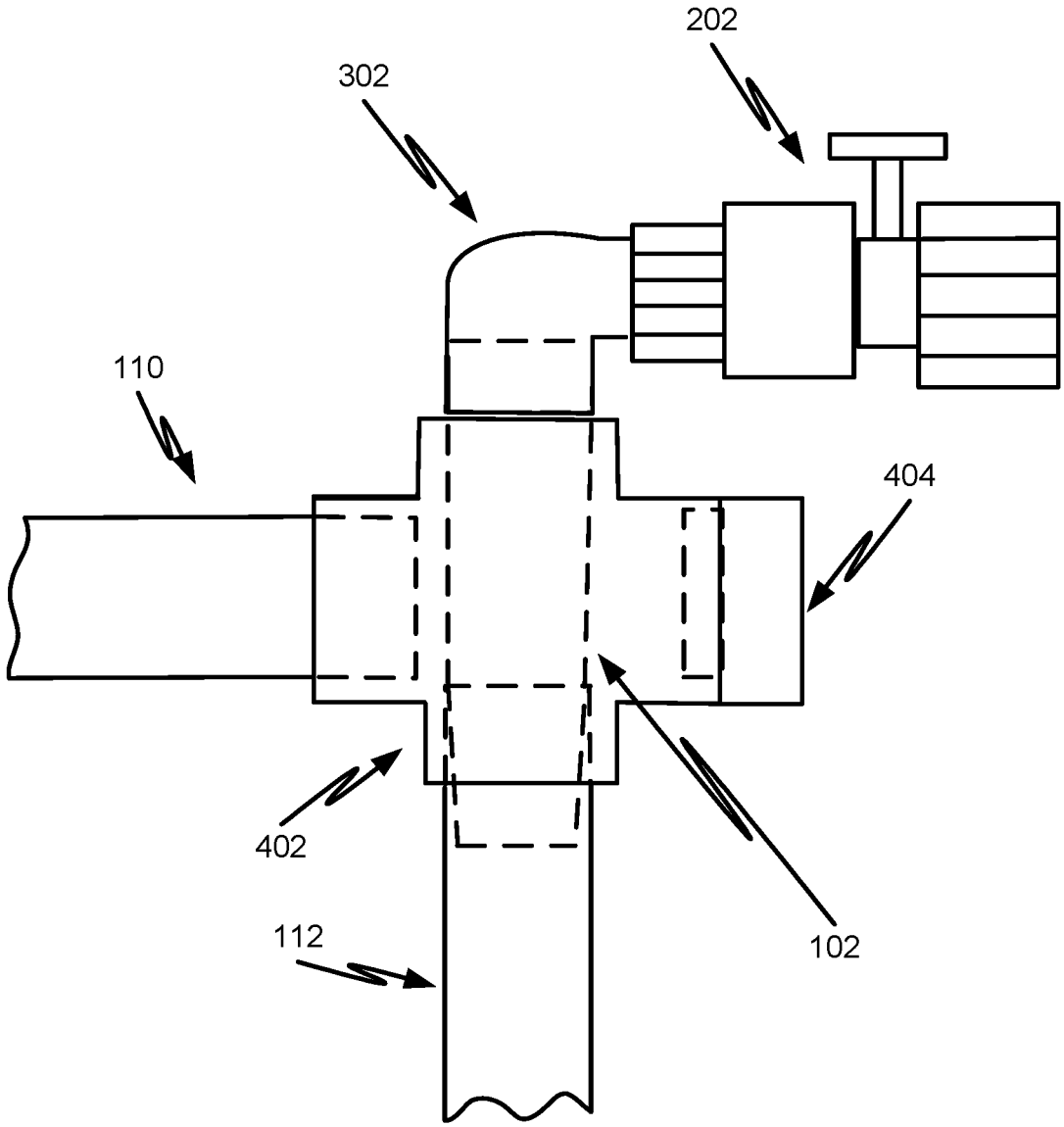
FIG. 5 shows a side elevation view of a drain cleaning device in accordance with some implementations.

FIG. 5 shows a side elevation view of a drain cleaning device in accordance with some implementations. As shown in FIG. 5, the drain line cleaning device 102 has been inserted through the connector 402 and into an opening of the drain line 112 within the connector 402.

Figure 6:
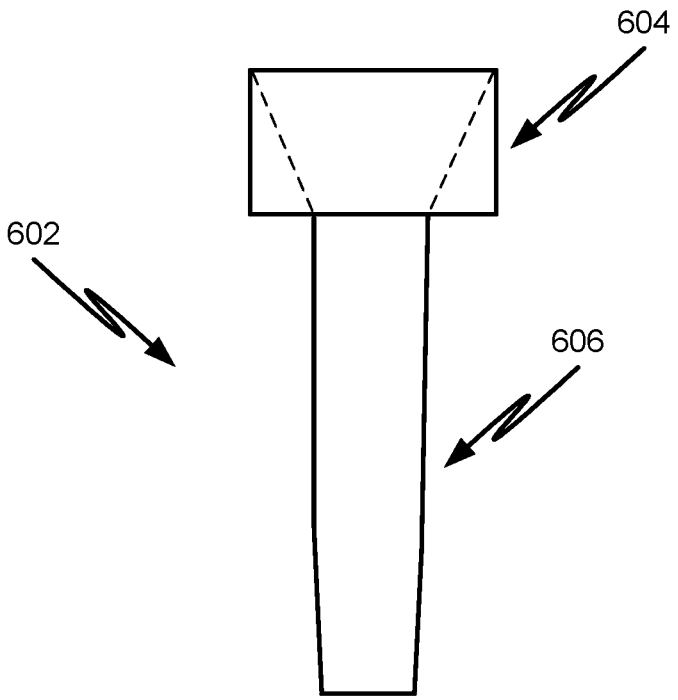
FIG. 6 shows a drain line cleaning funnel that forms a portion of a drain line cleaning kit along with the drain line cleaning device in accordance with some implementations.

FIG. 6 shows a drain line cleaning funnel 602 that forms a portion of a drain line cleaning kit along with the drain line cleaning device (e.g., along with one or more of 102 and/or 202) in accordance with some implementations. The drain line cleaning funnel 602 includes an upper funnel portion 604 and a tapered lower funnel portion 606.

In operation, fluid (e.g., water, cleaning solution such as a bleach solution, etc.) can be poured into the upper funnel portion 604. The fluid flows down from the upper funnel portion and into the tapered lower funnel portion 606 and into a drain line to help clean or clear the drain line.

Figure 7:
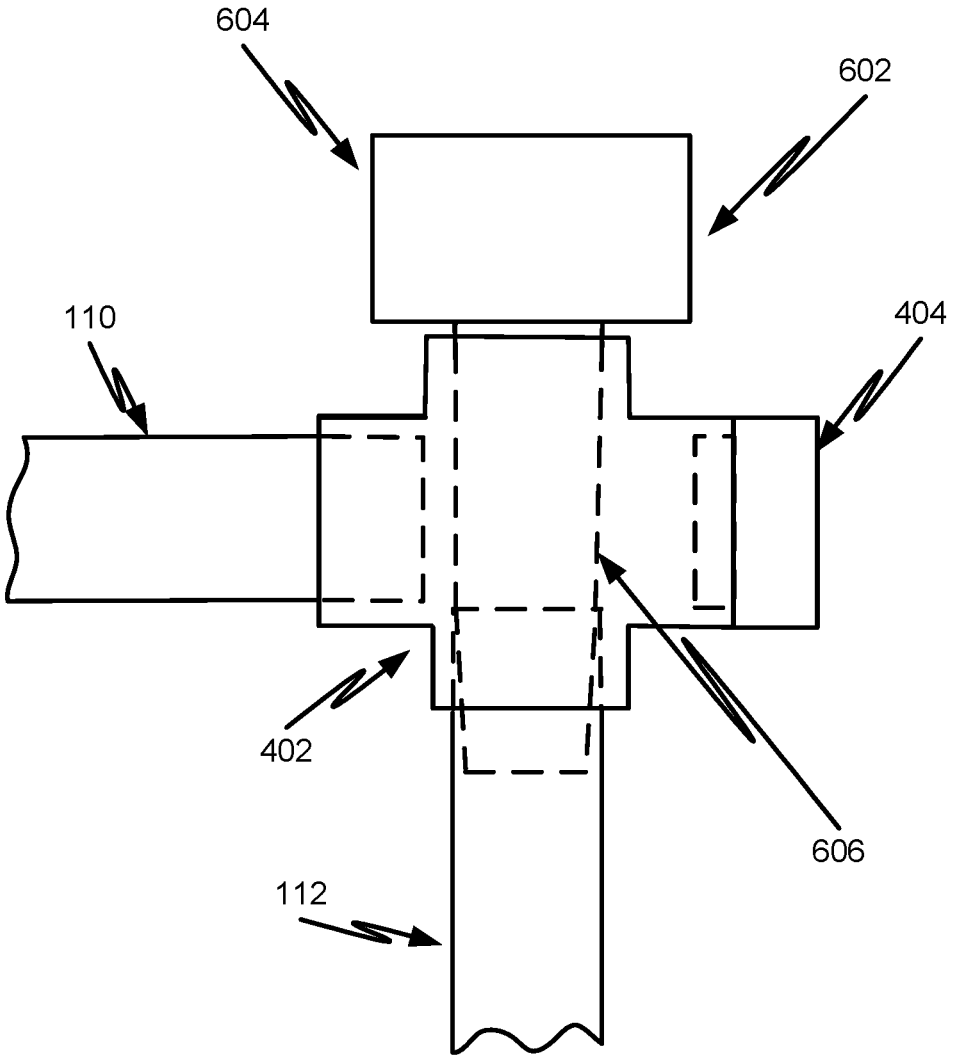
FIG. 7 shows a side elevation view of a drain cleaning funnel in accordance with some implementations.

FIG. 7 shows a side elevation view of a drain cleaning funnel 602 in accordance with some implementations. The drain line cleaning funnel 602 is shown inserted into an opening of a drain line 112 within a connector 402.

It is, therefore, apparent that there is provided in accordance with the presently disclosed subject matter, a drain line cleaning device and kit. While this disclosed subject matter has been described in conjunction with a number of embodiments, it is evident that many alternatives, modifications and variations would be or are apparent to those of ordinary skill in the applicable arts. Accordingly, applicant intends to embrace all such alternatives, modifications, equivalents and variations that are within the spirit and scope of the disclosed subject matter.

What is claimed is:

1. A drain line cleaning device comprising:

a male threaded upper portion configured to connect to a source of liquid;

a tapered lower portion coupled to the male threaded upper portion to transfer liquid from the male threaded upper portion to an opening at a distal end of the tapered lower portion; and an hose connector threaded onto the male threaded upper portion, the hose connector having a first female threaded connector to connect to the male threaded upper portion, a body having a single valve to variably control flow of liquid from the source of liquid through the hose connector, wherein the body is disposed between the first female threaded connector and a second female threaded connector to receive and connect directly to a hose that is connected to the source of liquid, wherein the tapered lower portion is configured to engage a plumbing connection of an air conditioning system condensate drain line via an interference fit, and wherein the distal end of the tapered lower portion, when engaged in the plumbing connection, extends past an air handler side of the plumbing connection and into an outlet side of the plumbing connection such that liquid flowing from the source of liquid flows through the tapered lower portion and into the outlet side without entering the air handler side of the plumbing connection to flush out the air conditioning system condensate drain line.

2. The drain line cleaning device of claim 1, further comprising a first end cap inserted into a first opening of the plumbing connection and a second end cap inserted into a second opening of the plumbing connection.

3. A drain line cleaning kit comprising:

a drain line cleaning device comprising:

a male threaded upper portion configured to connect to a source of liquid; and a tapered lower portion coupled to the male threaded upper portion to transfer liquid from the male threaded upper portion to an opening at a distal end of the tapered lower portion, wherein the tapered lower portion is configured to engage a plumbing connection of an air conditioning system condensate drain line via an interference fit, and wherein the distal end of the tapered lower portion, when engaged in the plumbing connection, extends past an air handler side of the plumbing connection and into an outlet side of the plumbing connection such that liquid flowing from the source of liquid flows through the tapered lower portion and into the outlet side without entering the air handler side of the plumbing connection to flush out the air conditioning system condensate drain line;

a hose connector threaded onto the male threaded upper portion, the hose connector having a first female threaded connector to connect to the male threaded upper portion, an angled body having a single valve to variably control flow of liquid from the source of liquid through the hose connector, and a second female threaded connector to receive and connect directly to a hose that is connected to the source of liquid, wherein the angled body is disposed between the first female threaded connector and the second female threaded connector; and a drain line funnel comprising:

an upper funnel to receive liquid poured into the upper funnel, wherein the upper funnel includes an interior wall that slopes from an outer edge toward an opening leading to a tapered lower funnel portion coupled to the upper funnel, wherein the tapered lower funnel portion is configured to engage a plumbing connection of an air conditioning system condensate drain line via an interference fit, and wherein the tapered lower funnel portion, when engaged in the plumbing connection, extends past the air handler side of the plumbing connection and into the outlet side of the plumbing connection such that liquid flowing from the source of liquid flows through the tapered lower funnel portion and into the outlet side without entering the air handler side of the plumbing connection, and wherein the liquid poured into the upper funnel flows through the upper funnel into the tapered lower funnel portion and into a pipe inserted into the plumbing connection.

4. The drain line cleaning kit of claim 3, wherein the plumbing connection is one of an angled connector, a T-shaped connector, or a four-way connector.

5. The drain line cleaning kit of claim 4, further comprising a first end cap inserted into one opening of the four-way connector and a second end cap inserted into another opening.

6. A drain line cleaning device comprising:

a male threaded upper portion configured to connect to a source of liquid;

a tapered lower portion coupled to the male threaded upper portion to transfer liquid from the male threaded upper portion to an opening of the tapered lower portion, wherein the tapered lower portion is configured to engage a plumbing connection of an air conditioning system condensate drain line via interference fit, and wherein the tapered lower portion, when engaged in the plumbing connection, extends past an air handler side of the plumbing connection and into an outlet side of the plumbing connection such that liquid flowing from the source of liquid flows through the tapered lower portion and into the outlet side without entering the air handler side of the plumbing connection; and a hose connector threaded onto the male threaded upper portion, the hose connector having a first female threaded connector to connect the hose connector to the male threaded upper portion of the drain line cleaning device and a second female threaded connector to receive and connect directly to a hose.

7. The drain line cleaning device of claim 6, wherein the plumbing connection is one of an angled connector, a T-shaped connector, or a four-way connector.

8. The drain line cleaning device of claim 7, further comprising a first end cap inserted into one opening of the four-way connector and a second end cap inserted into another opening.

9. The drain line cleaning device of claim 6, further comprising a valve that is adjustable to control flow of liquid through the hose connector.

* * * * *